United States Patent [19]

Jones

[11] 4,119,342

[45] Oct. 10, 1978

[54] CONVERTIBLE CHAIR STRUCTURE

[76] Inventor: Claude C. Jones, 303 N. Library, Waterloo, Ill. 62298

[21] Appl. No.: 792,355

[22] Filed: Apr. 29, 1977

[51] Int. Cl.[2] ..... A47C 1/02

[52] U.S. Cl. ..... 297/80; 5/81 R; 297/DIG. 4

[58] Field of Search ..... 297/68, 90, 91, 71, 297/64, 411, 80, 85, DIG. 4, 118; 5/81 B, 81 R; 108/146

[56] References Cited

U.S. PATENT DOCUMENTS

| | | | |
|---|---|---|---|
| 505,321 | 9/1893 | Moreland | 297/80 X |
| 1,748,784 | 2/1930 | Mierley | 297/90 |
| 2,074,635 | 3/1937 | Larsen | 297/80 |
| 2,544,615 | 3/1951 | Raymond | 108/146 |
| 2,587,068 | 2/1952 | Sanders | 5/81 B |
| 3,147,039 | 9/1964 | Smith et al. | 297/90 |
| 3,265,432 | 8/1966 | Tabbert | 5/81 R |
| 3,495,869 | 2/1970 | Ingemanssoli | 5/81 R |
| 3,936,893 | 2/1976 | Anderson et al. | 297/90 |
| 4,039,223 | 8/1977 | Kristensson | 297/90 |

FOREIGN PATENT DOCUMENTS

| | | | |
|---|---|---|---|
| 979,288 | 12/1950 | France | 297/80 |

*Primary Examiner*—James T. McCall

*Attorney, Agent, or Firm*—Cohn, Powell & Hind

[57] ABSTRACT

This chair structure is convertible from a wheelchair seating mode to a horizontal or prone mode and includes a base having ground wheels attached thereto and providing a mounting for a chair superstructure. In the seating mode the superstructure includes back and front portions interconnected by seat and arm portions which cooperate to form a folding linkage system. The back portion is rotatably mounted to a post forming part of the base, and the seat portion is adjustably mounted to the base, so that when the back portion is rotated about the base post, the back, front, seat and arms are unfolded into a substantially unobstructed horizontal platform in the prone mode. The substantially flat, horizontal platform can be moved into overlapping relation with a hospital bed to permit a patient to be easily transferred onto the platform which is then folded into the seating mode for transportation of the patient to a different hospital station.

3 Claims, 10 Drawing Figures

CONVERTIBLE CHAIR STRUCTURE

BACKGROUND OF THE INVENTION

This invention relates generally to a convertible chair structure and particularly to a structure which can be folded from a seating mode to a prone mode.

The transferring of a patient from a hospital bed into a conventional wheel chair for transporting the patient to another part of the hospital is currently a very difficult procedure and one which requires the services of several nurses or nurses aides. The task of moving even a relatively lightweight patient, unable to provide self-help, cannot be achieved without great difficulty. Structures which can be converted from a chair configuration to a cart or a bed configuration are well known. However, in general these devices are intended either for optional use as stretchers, see U.S. Pat. No. 3,137,551 or as cots, see U.S. Pat. No. 2,377,649 and U.S. Pat. No. 3,112, 001. Such structures are invariably complicated and therefore expensive. Further, they are not intended to assist in transferring a patient from a hospital bed to mobile carrier for transportation to a different hospital station.

The present structure overcomes the inherent problems in convertible chair structures in a manner not disclosed in the known prior art. .

SUMMARY OF THE INVENTION

This convertible chair structure provides a means of readily transferring a hospital patient onto a horizontal, obstruction-free platform in a prone mode and, when this is accomplished, provides a means folding the structure into a seating mode without removing the patient, so that the patient can be wheeled to another hospital station.

The structure includes a base having ground wheels and mounting a superstructure consisting of back means defining first and second hinge points, front means defining first and second hinge points, seat means connected between the back means and the front means at the first hinge points and arm means connected between the back means and the front means at the second hinge points, the hinge points cooperating with the back, front, seat and arms to define a four-sided linkage when the structure is in the seating mode tending to approach alignment when the structure is rotated into the prone mode. The structure includes mounting means connecting the back means to the base means in pivotal relation for rotation of the back means from a substantially upright position in the seating mode, to a substantially horizontal position in the prone mode. Support means are provided operatively connecting the seat means to the base means in both the seating mode and in the prone mode.

The back means includes an upper portion and a lower portion of reduced width; the front means includes a lower portion and a bifurcated upper portion. The seat means is connected between the lower portion of the back means and the bifurcated upper portion of the front means and has a width substantially equal to the reduced lower portion of the back means. The arm means are connected between the upper portion of the back means and the bifurcated upper portion of the front means.

The base includes a post and the back means includes a transverse bracket connecting the back means to the post so that the seat means is at a correct elevation in the seating mode and so that in the prone mode the back, front, seat and arms present a substantially planar surface disposable in overlapping relation with a hospital bed.

The back and front of the structure are connected by additional bracing link means and the support means includes an adjustable leg attached to the seat at one end and connected to the base in bearing relation at the other end.

The support includes a first releasable detent means engageable with the adjustable leg to hold the structure in the prone mode and a second releasable detent means engageable with the base post to hold the structure in the seating mode. Cable actuating means is provided which releases both detent means by operation of a single trigger control.

This chair structure is simple in construction, relatively inexpensive to manufacture and can be used with facility by a single operator.

DESCRIPTION OF THE PREFERRED EMBODIMENT

Figure 1:
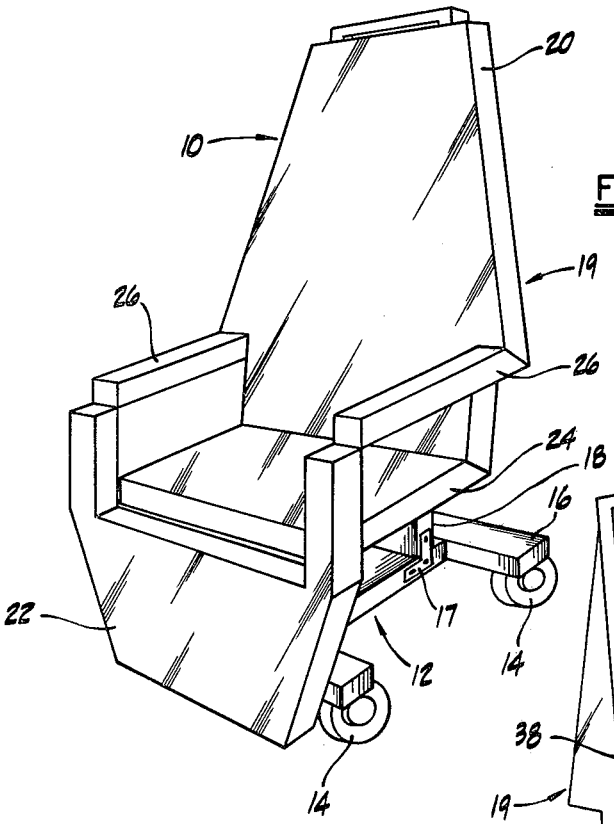
FIG. 1 is a perspective view of the chair structure in the seating mode viewed from the front.
Figure 2:
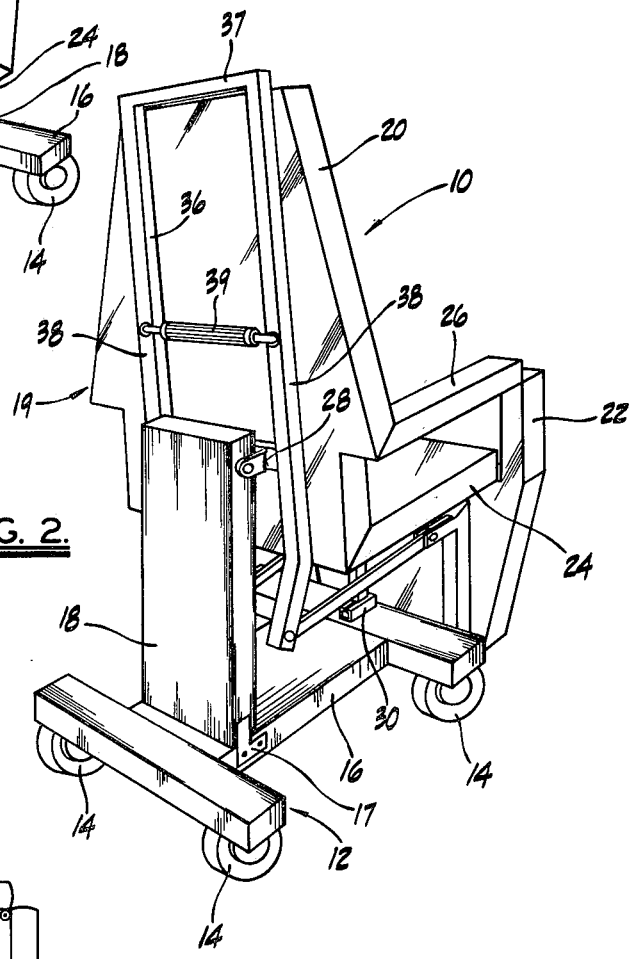
FIG. 2 is a perspective view of the structure in the seating mode viewed from the rear.
Figure 3:
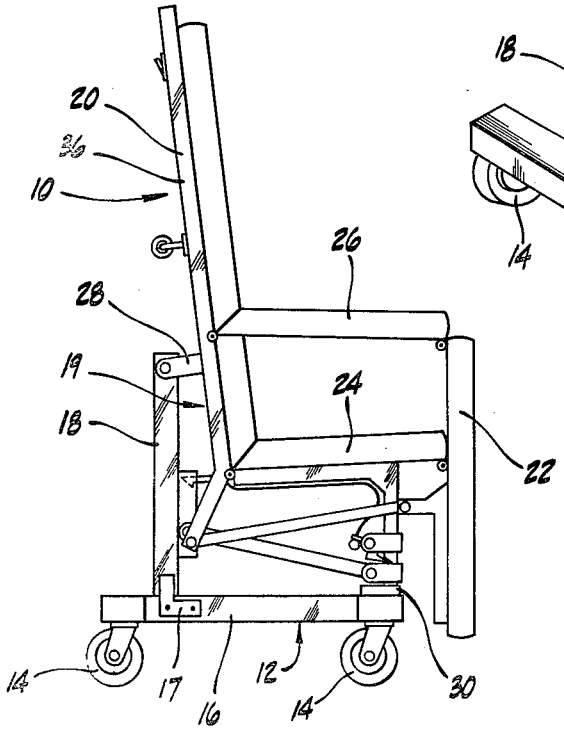
FIG. 3 is a side elevational view of the structure.
Figure 4:
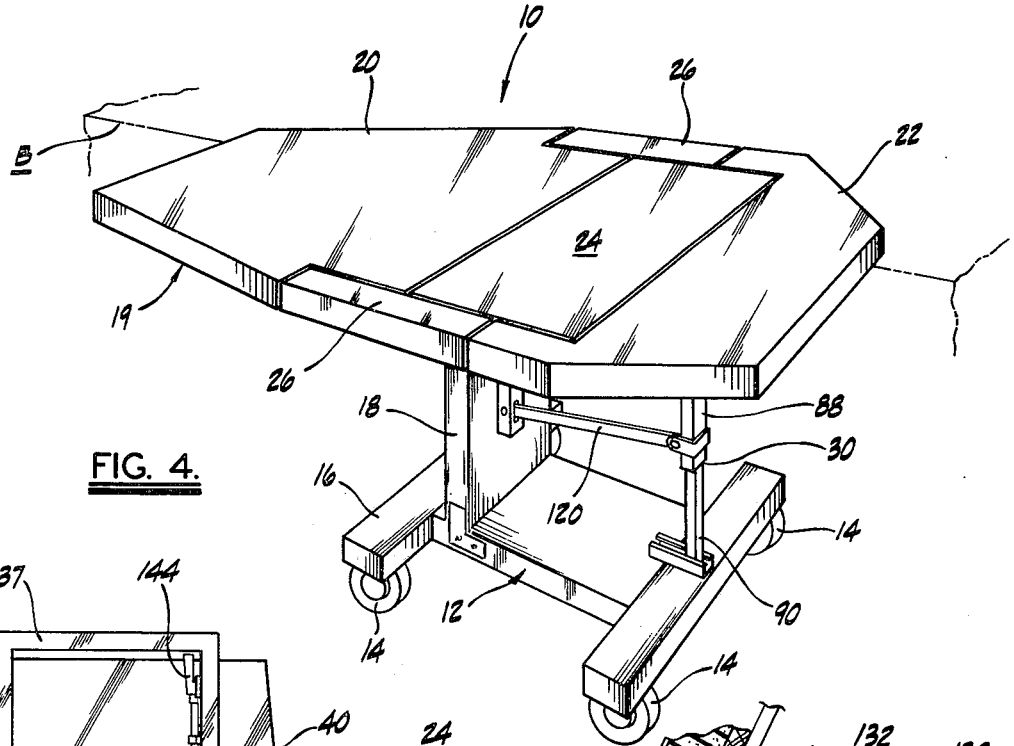
FIG. 4 is a perspective view of the structure in the prone mode viewed from the front.

Referring now by reference numerals to the drawing and first to FIGS. 1, 2 and 4 it will be understood that the convertible chair generally indicated by numeral 10 includes a base 12 having a lower, substantially horizontal I-shaped platform 16 providing a mounting for castor-type ground wheels 14 and an upwardly extending post 18 attached to the platform as by brackets 17. The base 12 provides a mounting means for the chair superstructure generally indicated by numeral 19 which includes a back portion 20, a front portion 22, a seat portion 24 and arm portions 26 extending between the front and rear portions 20 and 22. The back portion 20 is pivotally mounted to the base post 18 by means of a bracket 28, constituting a mounting means, and the seat portion 24 is supported on the base platform 16 by means of an adjustable support assembly generally indicated by numeral 30. The component parts of the chair structure 10 will now be described with particular reference to FIGS. 5 through 10.

Figure 5:
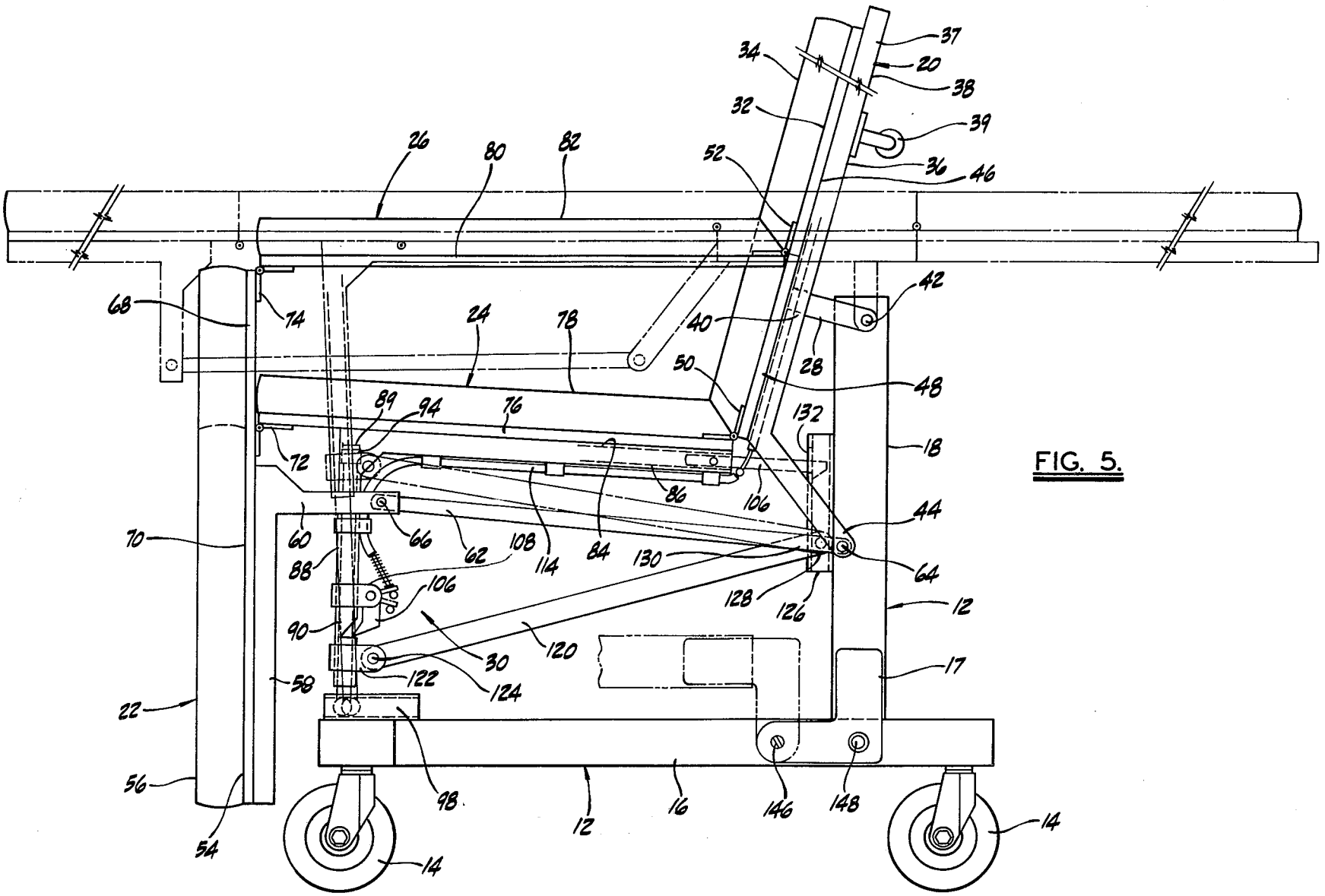
FIG. 5 is an enlarged fragmentary side elevational view of the structure illustrating the disposition of parts in the seating mode and the prone mode.

As shown in FIG. 5 the back portion 20 consists essentially of a plate member 32 of plywood or similar suitable material, which forms a base for an upholstered cushion portion 34 and provides a mounting for a substantially U-shaped frame 36 which is attached to said member 32 as by fasteners (not shown). The U-shaped frame 36 includes a bight portion 37, which provides a pull means, and downwardly depending legs 38, to which are attached a handle 39. A cross member 40, which is welded or otherwise connected between the legs 38 of said frame 36, provides a means of attachment for the mounting brackets 28, the remote ends of which are rotatably mounted to the base post 18 by means of a pivot connection 42. The legs of the U-shaped frame 36 extend below the back member 32 to provide a pair of angularly related downwardly projecting portions 44. The plate member 32 includes an upper portion 46 and a lower portion 48 of reduced width and two pairs of hinged elements 50 and 52 are attached to the inside face of said lower and upper portions 48 and 46 respectively and define first and second hinge points.

The front portion 22 includes a plate member 54 of plywood or similar suitable material, providing a base for a cushioned portion 56. A pair of L-shaped frames 58 are attached to the inner face of the member 54 and provide inwardly projecting portions 60 which are substantially aligned with downwardly projecting portions 44 of the U-shaped frame 36 and are connected to said members 44 by means of link members 62, pivotally connected to said members 44 and 58 respectively by pivot connections 64 and 66. The front plate member 54 includes a bifurcated upper portion providing upwardly extending members 68 and a lower portion 70. Hinge elements 72 and 74 are fixedly attached to the inside face of said lower and upper portions 70 and 68 and define first and second hinge points respectively. The seat portion 24 includes a plate member 76 of plywood or similar suitable material, providing a base for a cushion portion 78. The seat plate member 76 is of substantially the same width as the reduced portion 42 of the back plate member 32 which is substantially equal to the distance between the members 68 of the front plate member 54 and said seat plate member is connected between said back plate member 32 and said front plate member 54 by the hinge elements 50 and 72 respectively, which are fixedly attached to the upper and lower face respectively of said seat plate member 76. Each of the arm portions 26 includes a plate member 80 providing a base for a cushion portion 82. The arm portions 26 are connected between the back plate member 32 and the front plate member 54 by means of hinge elements 52 and 74 respectively, which are fixedly attached to the upper face and lower face respectively of plate member 80. The arm plate members 80 are of substantially the same width as the front plate members 68 and the cut out portions of the back plate member 32 resulting from the reduced width of the lower portion thereof, so that when the superstructure 19 is unfolded into the prone position (see FIG. 4) the back, front, seat and arm portions form a substantially unobstructed planar surface.

Figure 6:
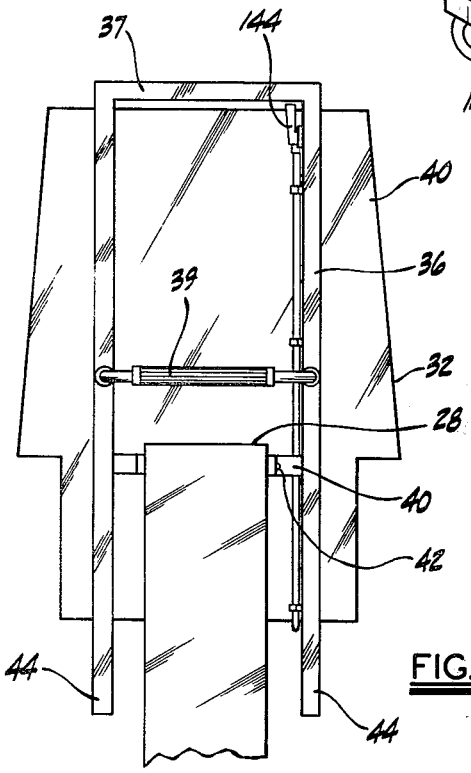
FIG. 6 is a fragmentary rear elevational view.
Figure 7:
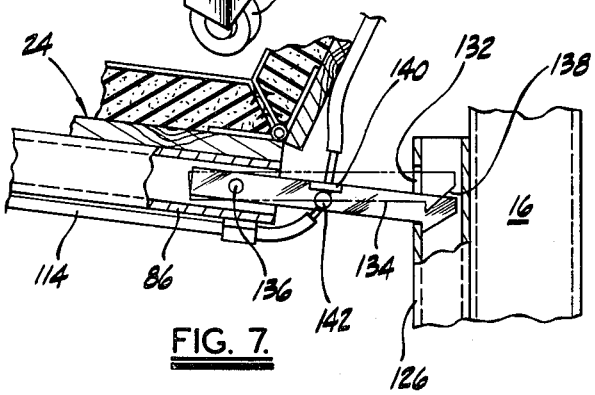
FIG. 7 is an enlarged fragmentary view of the latch maintaining the structure in the seating mode.
Figure 10:
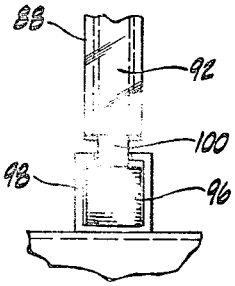
FIG. 10 is an end view of the detail shown in FIG. 9.
Figure 9:
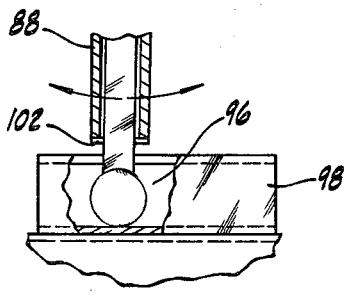
FIG. 9 is an enlarged detail of the foot of the adjustable leg member.

The support assembly 30, which provides a means by which the chair superstructure 19 is supported on the base 12, will now be described. The support assembly 30 includes a single L-shape tubular member 84 which has an elongate member 86 attached to the seat plate member 76 as by fasteners (not shown) and a depending member 88, which receives an adjustable member 90 therewithin in telescopic relation and constitutes a leg portion. The telescopic member 90 is best shown by reference to FIGS. 8, 9 and 10 and includes a rod 92 having an enlarged end 94 slidably mounted within the tubular member 88 and a lower end having a hammerhead configuration provided by welding a short cylindrical rod 96 transversely to the rod 92. A retainer member 98, which is welded or otherwise attached to the base platform 16, provides a slot 100 overlapping the enlarged end 96. The tubular member 88 is provided with a stop 89 (FIG. 5) at its upper end, against which the adjustable member upper and 94 engages when said member is fully retracted, and said tubular member 88 is provided with an apertured plate 102 welded or otherwise attached to its lower end which is engageable with the enlarged upper end 94 of said adjustable member to preclude inadvertent removal of the said member 90 from the tubular member 88 when said member is fully extended. As clearly shown in FIG. 8, the tubular member 88, within which the rod 92 is mounted, is notched to provide a cut-away portion 104 exposing the adjustable member 90 within said tubular member 88. A latch member 106, constituting a first detent means, is pivotally mounted to a bracket member 108 fixedly attached to said member 88. The latch member 106 includes a cam edge 110 and an engaging edge 112 and when the adjustable member is telescopically extended the enlarged head 94 is moved relatively within the tubular member 88 until the head engages the latch member 106 and cams it outwardly. When the head 94 passes the camming edge of the latch member 106, said member is urged inwardly thereby into the notch 104 to engage the upper face of said head 94. The latch member 106 is actuated by a cable 114 which is attached to a lug 116 and includes a return spring 118. As shown in FIG. 5, the tubular member 88 is connected to the post member 18 by means of a brace provided by a link member 120, which is connected to a clamp 122 at pivot connection 124, and to a tubular member 126 by pivot connection 128. The tubular member 126 is fixedly attached to and forms part of the base post member 18 and includes a slot 130 at its lower end to receive the link member 120. As best shown in FIG. 7, the tubular member 126 also includes a slot 132 at its upper end which provides a connection point for a second latch member 134 which holds the superstructure in the seating mode. This latch member 134, which constitutes a second detent means, is mounted within the tubular member 86 by a pivot connection 136. The latch member 134 includes a cammed end 138 which provides a lip engageable with the lower edge of slot 132. The latch member 134 also includes an apertured, transverse lug 140 which is actuated by the same cable 114 which actuates the adjustable member latch 106. To this end, the cable 114 is provided with a stop means 142 which engages the under side of lug 140 to move the latch member 134 upwardly and disengage the cammed end 138 when the cable is actuated. The cable is actuated by a trigger control 144 which is mounted, as shown in FIG. 6, to the U-shaped frame 36 of the back portion. It will be understood that the same trigger action releases the latch 134 in the seating mode and the latch 106 in the prone mode.

It is thought that the structural features and functional advantages of this convertible chair have become fully apparent from the foregoing description of parts but for completeness of disclosure the operation of the device will be briefly described.

Figure 8:
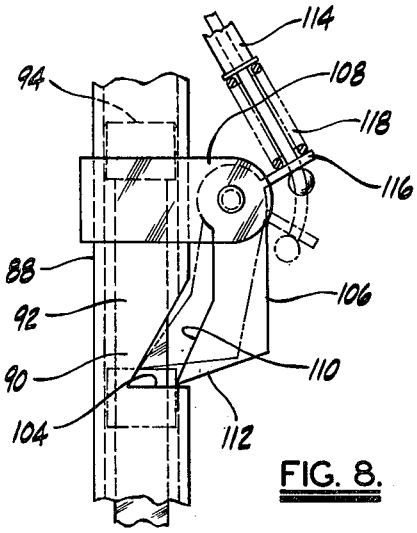
FIG. 8 is an enlarged fragmentary view of the latch maintaining the structure in the prone mode.

It will be assumed that chair 10 is initially in the prone mode shown in FIG. 4. When it is desired to transfer a patient from a hospital bed such as that indicated by B, the nurse turns the patient onto one side and then, with the chair superstructure 19 horizontal as shown, the nurse pushes said superstructure into overlapping relation with the bed B. It will be understood that the configuration of the base 12, and in particular the base post 18, provides that the chair superstructure can overlap the bed B. The overlap in the preferred embodiment is about 7 inches and the horizontal edge of the superstructure, formed by the back, arm and front portions, can readily be pushed up to the patient's back and the patient is rolled over onto the platform created by the front, back, seat and arm portions. The foam cushioning is quite compressible and in the preferred embodiment compresses to approximately 1 inch so that there is a minimum obstacle encountered by the patient. When the patient is lying in the prone position on the horizontal surface correctly oriented with his back, seat and legs arranged to correspond approximately with the back portion 20, the seat portion 24 and the front portion 22 respectively, the control trigger 144 (FIG. 6) is actuated. This causes the latch member 106, as shown in FIG. 8, to be urged out of engagement with the head 94 of the adjustable member 90 to release said member 90 and permit it to telescope into the tubular member 88. By pushing upwardly on the U-shaped frame bight portion 37, the back portion 20 rotates in a counterclockwise direction about the base post pivot connection 42 assisted by the weight of the patient until the telescoping leg member 90 engages stop 89 within the tubular member 88. The provision of the link member 120, which connects the post 18 to the support assembly tubular member 88, and the nature of the retention between the lower portion of the adjustable member 90 and the base portion retainer member 98 permits the pivot 94 of the adjustable member to move transversely the necessary amount without being disengaged from said member 98. When the structure approaches the seating mode the latch member 134 enters the slot 132 and is cammed into the latch position. It will be understood that the cushioning at the corners of the ends of the arms and seat portions engaging the back portion is originally square but is readily compressed as shown in FIG. 7 into a diagonal formation. Because of the provision of the mounting bracket 28, which connects the back portion 20 to the base post 18, the elevation of the seat portion 24 is lower than it would be if the back portion 20 were directly pivoted to said post. This results in a more convenient and comfortable seat height for the patient rendering it relatively easy for the patient to stand up or sit down in the chair without strain.

It will be understood that with the patient in the sitting position the chair 10 can be wheeled in much the same manner as a conventional wheel chair. When it is desired to return the patient into the bed B the chair is pushed into position adjacent said bed. The trigger control 144 is then actuated which results, as indicated in FIG. 7, in the unlatching of the latch member 106 so that the back portion can be rotated in a clockwise direction, carrying the front, seat and arm portions with it into the prone mode. As the seat portion 24 rotates upwardly, the adjustable leg member 90, which is held at its lower end by the base retainer member 98, is pulled outwardly telescopically. When the prone mode is achieved the head 94 of the adjustable member 90 is relatively below the latch member 106 and the return spring 118 of the cable 114 permits said latch to enter the notch 104 and thereby bring the latch member into engagement with the head of the adjustable member to stabilize the structure in the prone position. The link member 62 provides a brace means between the back and front portions 20 and 22 so that the front portion 22 is better able to resist inadvertent downward movement away from the prone mode.

It will be understood that the particular arrangement of the four pin linkage system ensures that the chair seat portion 24 and back 20 are inclined to a comfortable seating position even though the hinge points are substantially aligned in the prone position. This is achieved by providing that while the sum of the spacing between hinge points of hinges 72, 74 and 74, 52 is equal to the sum of the spacing of the hinge points of hinges 72, 50 and 50, 52; the spacing between hinge points 50, 52 is greater than that between points 72, 74 and the spacing between points 74, 52 is greater than that between points 72, 50. In the preferred embodiment, the approximate spacing between points 50, 52 is 10 inches; between points 72, 74 is 9 inches; between points 74, 52 is 20 inches and between points 72, 50 is 21 inches.

When the chair superstructure 19 is in the prone position, the now horizontal front, back, seat and arm combination can be pushed into overlapping relation with the bed B and the patient rolled on his side onto the bed B and the chair 10 then pulled away.

As shown in FIG. 5, the bracket 17 connecting the base post member 18 to the base platform member 16 can be fixedly attached to the post member as by welding, and bolted to the platform member by bolts 146 and 148, bolt 148 being removable to permit the post 18 to be folded for storage.

I claim as my invention:

1. A chair structure convertible from a seating mode to a prone mode comprising:

(a) base means, including ground wheel means, (b) back means including an upper portion and a lower portion of reduced width, and including first and second hinge points disposed in spaced relation, (c) front means having a lower portion and a bifurcated upper portion and including first and second hinge points disposed in spaced relation, (d) seat means connected between said back means and said front means at said first hinge points and receivable between said bifurcated upper portion, (e) arm means connected between said back means and said front means at said second hinge points and disposed on either side of said seat means, (f) mounting means operatively connecting the back means to the base means in pivotal relation for rotation of the back means from a substantially upright position in the seating mode to a substantially horizontal position in the prone mode, (g) said front hinge points and said back hinge points defining a four sided linkage when said structure is in the seating mode tending to approach alignment when the structure is rotated into the prone mode, (h) support means operatively connecting the seat means to the base means, and (i) the seat means being of substantially the same width as the reduced portion of the back means and the distance between the bifurcated portion of the front means.

2. A structure as defined in claim 1, in which:

(j) the back means includes a frame having a pair of spaced, downwardly projecting portions, (k) the front means includes a frame having a pair of spaced, inwardly projecting portions, and (1) a pair of brace link elements are pivotally connected between associated front and back projecting portions.

3. A structure as defined in claim 2, in which:

(m) the support means includes an L-shaped frame having one leg fixedly connected to the seat means and another leg depending from said seat means and including an adjustable, telescopic portion having an enlarged remote end, and (n) the base means includes a horizontal portion having a retaining portion receiving said remote end in moving and bearing relation.

* * * * *